US005630286A

United States Patent [19]

Vanderlinden

[11] Patent Number: 5,630,286

[45] Date of Patent: May 20, 1997

[54] VEHICULAR APPARATUS FOR REMOVING DE-ICING LIQUID

[75] Inventor: Glenn M. Vanderlinden, Vinemount, Canada

[73] Assignee: Zenon Airport Environmental, Inc., Burlington, Canada

[21] Appl. No.: 331,923

[22] Filed: Oct. 31, 1994

Related U.S. Application Data

[63] Continuation-in-part of Ser. No. 155,132, Nov. 22, 1993.

[51] Int. Cl.[6] ..... F01H 5/04

[52] U.S. Cl. ..... 37/227; 37/228; 37/232; 37/237; 15/322; 15/340.3

[58] Field of Search ..... 37/197, 209, 210, 37/227, 228, 229, 232, 233, 234, 237, 238, 241, 244, 248; 15/320, 322, 340.3, 340.4

[56] References Cited

U.S. PATENT DOCUMENTS

| | | | |
|---|---|---|---|
| 294,084 | 2/1884 | Schulze | 37/209 X |
| 999,445 | 8/1911 | Friedman | 37/228 |
| 1,462,527 | 7/1923 | Tully | 37/228 |
| 1,462,903 | 7/1923 | Finley | 239/556 |
| 1,629,160 | 5/1927 | Heermance | 37/227 X |
| 2,149,453 | 3/1939 | Longshore et al. | 15/320 |
| 2,261,006 | 10/1941 | Sweeney | 37/228 |
| 2,261,732 | 11/1941 | O'Brien | 37/228 X |
| 2,300,280 | 10/1942 | Teager | 15/340.3 X |
| 2,930,055 | 3/1960 | Fallen et al. | 15/320 X |
| 2,977,955 | 4/1961 | Altenburg | 37/227 X |
| 3,011,206 | 12/1961 | Breither | 15/320 |
| 3,066,428 | 12/1962 | Raiti | 37/228 |
| 3,193,867 | 7/1965 | Daneman et al. | 15/314 |
| 3,197,798 | 8/1965 | Brown et al. | 15/320 |
| 3,213,481 | 10/1965 | Minerley | 15/320 |
| 3,273,193 | 9/1966 | Soderholm et al. | 15/320 |
| 3,304,632 | 2/1967 | Kotlar et al. | 37/228 |
| 3,404,470 | 10/1968 | Raiti | 37/228 |
| 3,419,251 | 12/1968 | Eckert | 239/556 |
| 3,447,188 | 6/1969 | Maasberg | 15/320 |
| 3,456,368 | 7/1969 | Jacques | 37/227 |
| 3,824,645 | 7/1974 | Krier et al. | 15/50.3 |
| 3,828,919 | 8/1974 | Holtsclaw et al. | 198/728 X |
| 4,023,233 | 5/1977 | Prestwich | 15/320 |
| 4,158,901 | 6/1979 | Wulff et al. | 15/320 X |
| 4,164,820 | 8/1979 | Krickovich | 37/229 |
| 4,168,562 | 9/1979 | Maasberg | 15/320 |
| 4,171,551 | 10/1979 | Hildebrand et al. | 15/84 |
| 4,236,756 | 12/1980 | Hildebrand et al. | 298/11 |
| 4,271,617 | 6/1981 | Yoshizawa | 37/197 |
| 4,363,152 | 12/1982 | Karpanty | 15/320 X |
| 4,369,540 | 1/1983 | Burgoon et al. | 15/49.1 |
| 4,429,433 | 2/1984 | Burgoon | 15/320 |
| 4,608,725 | 9/1986 | Jackson | 15/3 |

(List continued on next page.)

FOREIGN PATENT DOCUMENTS

| | | | |
|---|---|---|---|
| 615273 | 2/1961 | Canada | 37/228 |
| 689055 | 6/1964 | Canada | 37/228 |
| 830788 | 12/1969 | Canada | 37/227 |
| 194565 | 9/1986 | European Pat. Off. | 37/228 |
| 3133789 | 8/1981 | Germany . | |
| 1159057 | 7/1969 | United Kingdom . | |

*Primary Examiner*—Blair Johnson
*Assistant Examiner*—Andrea Chop
*Attorney, Agent, or Firm*—Andrew Alexander

[57] ABSTRACT

A vehicular apparatus adapted for removing fluids including snow and/or ice and de-icing liquids from a surface as the apparatus traverses the surface. The apparatus comprises: a first container for receiving a first portion of the fluids removed from a zone of the surface; apparatus for collecting and transferring the first portion of the fluids from the zone to the first container; a second container for collecting residual fluids remaining on the zone of the surface after the first portion is removed; apparatus for impinging water at high pressure on the zone of the surface to loosen the residual fluids or make them airborne; and an air sweep connected in fluid communication with the second container for drawing or sweeping the loosened residual fluids and water into the second container concurrently with impinging high pressure water on the surface.

15 Claims, 9 Drawing Sheets

U.S. PATENT DOCUMENTS

| | | | |
|---|---|---|---|
| 4,760,657 | 8/1988 | Ganzmann et al. | 37/232 |
| 4,785,561 | 11/1988 | Swanson | 37/228 X |
| 4,827,637 | 5/1989 | Kahlbacher | 37/233 X |
| 4,845,801 | 7/1989 | Milly et al. | 15/321 |
| 4,974,779 | 12/1990 | Araki et al. | 239/566 X |
| 5,079,865 | 1/1992 | Hutson | 37/229 |
| 5,110,366 | 5/1992 | McGregor | 239/556 X |
| 5,224,236 | 7/1993 | Sallquist | 15/321 |
| 5,239,720 | 8/1993 | Wood et al. | 15/4 |
| 5,331,713 | 7/1994 | Tipton | 15/320 |
| 5,406,673 | 4/1995 | Bradd et al. | 15/320 X |
| 5,460,657 | 10/1995 | Ally | 15/320 X |
| 5,561,921 | 10/1996 | Vanderlinden | 37/227 |

VEHICULAR APPARATUS FOR REMOVING DE-ICING LIQUID

CROSS REFERENCE TO RELATED APPLICATIONS

This application is a continuation-in-part of U.S. Ser. No. 155,132, filed Nov. 22, 1993.

BACKGROUND OF THE INVENTION

This invention relates to snow and de-icing removal from runway surfaces, and more part particulary, it relates to a method and vehicular apparatus for traversing a surface to remove fluid such as snow and de-icing fluids therefrom.

With ever increasing air travel, there is greater pressure to fly aircraft during winter months which entails taking off and landing in snow storms. Taking off is particularly hazardous because of the extra weight of snow that can accumulate on the aircraft body and wings and interferes lift. To minimize snow accumulation, the aircraft is sprayed with a de-icing and/or anti-icing liquid. The de-icing liquid is a glycol formulation composed of either ethylene or diethylene glycol and/or propylene glycol or similar material. Generally, there are two types of de-icing liquid. A first type of de-icing liquid (Type I), while effective in de-icing, has a formulation that does not adhere well to the aircraft surface. Thus, after application of the de-icing liquid, of the aircraft is required to stay on the ground for a period of time prior to takeoff, the de-icing liquid can have lost some of its effectiveness in keeping snow of ice from accumulating on the aircraft. To care for this problem, a second kind of de-icing liquid (Type II) is used. The second de-icing liquid has the capability of adhering to the aircraft up to a speed of 80 or 90 knots. The newer formulation, by clinging to the aircraft surface, can end up further out on the take-off runway, potentially creating a problem for subsequent aircraft taking off and landing.

It is necessary to recover both de-icing formulations from the runway surface, or apron where the aircraft is sprayed, to meet environmental regulations and for safety concerns. By the use of "runway" or "runway surface" as used herein is meant to include the apron where the aircraft is sprayed with de-icing liquid. Thus, there is a great need to remove or recover the de-icing liquids economically.

However, the recovery of the liquid is complicated by the fact that it has to be recovered usually at freezing temperatures and that it is combined with snow and ice. Further, the second formulation has the additional problem that just as it is designed to cling to aircraft surfaces, it also clings to runway surfaces, making its recovery very difficult.

In prior attempts to recover the de-icing liquid, it has been found that brushing, sweeping or plowing snow combined with the de-icing liquid is largely ineffective because a residual amount of de-icing liquid remains on the runway surface. The residual amount is usually more than permitted by environmental regulations. Such regulations permit only a very low minimum amount, e.g., sometimes less than 5 mg/100 square centimeters in runoff water in some cases, to remain because the chemicals, e.g., glycols, eventually find their way to water supplies. Further, such recovery attempts are largely ineffective on packed snow or ice. Attempts at recovery of the de-icing liquids by vacuum also have been ineffective, particularly when the de-icing liquid is combined with snow or ice on the runway because the vacuum is not effective in removing ice or packed snow from the runway surface.

Many sweepers and machines are disclosed for cleaning paved surfaces. For example, U.S. Pat. No. 5,054,152 discloses a street sweeper that comprises side brushes, a pick-up brush and a conveyor mounted forward of the pick-up brush. The sweeper has a suspension component mounted forward of the rear axle which permits utilization of a standard production truck chassis. The disclosure of U.S. Pat. No. 5,054,152 is incorporated herein by reference.

U.S. Pat. No. 3,011,206 discloses a vehicle for cleaning streets wherein a scrubbing or sweeping brush is mounted on a chassis between the front and rear wheels of the vehicle, and while the vehicle is driven, the brush is rotated. In front of the rotary brush is a spraying or flushing mechanism which substantially consists of a pipe extending parallel to the brush. The pipe is connected to a fresh water supply and sprays powerful jets of water on the road along the length of the brush. A suction device is provided, and muddy water is drawn into a container by the effect of vacuum in the container.

U.S. Pat. No. 5,239,720 discloses a mobile surface cleaning machine that uses a sweeping-scrubbing apparatus including a sweeping brush for sweeping debris into a hopper and a one-piece squeegee for picking up solution after four staggered, disc brushes. The squeegee is U-shaped and has a longitudinal extent greater than that of the disc brushes located intermediate the legs of the squeegee. The squeegee has first and second blades that form a vacuum chamber to remove the cleaning solution.

U.S. Pat. No. 5,224,236 discloses a machine for cleaning paved surfaces to remove residues such as oil, grease and diesel fuel spills from streets. The machine has a water supply, recovery tanks and a steam generator for heating water from the supply tank to produce highly pressurized hot water and steam. A hose and wand are connected to the steam generator for directing pressurized water and steam against the surface to be cleaned. A pick-up wand is connected to a recovery tank having a vacuum pump for drawing water and residue from the surface.

U.S. Pat. No. 4,845,801 discloses a vehicle for cleaning surfaces with a first tank for storing cleaning liquid and a device for spraying a liquid at a first pressure and a first flow rate onto the surface to be cleaned. A device is provided for sucking the sprayed liquid towards a second tank. A second device is provided for moistening the surface to be cleaned with liquid at a second pressure and a second flow rate. The second pressure is lower than the first pressure and the second flow rate is lower than the first flow rate. The spraying and sucking devices are located at the rear of the vehicle, and the moistening device is located at the front of the vehicle. However, these machines are not effective for removing snow and/or ice and de-icing liquid combined therewith. Other street, surface or floor cleaning equipment is disclosed in U.S. Pat. Nos. 3,193,867; 3,447,188; 3,824,645; 4,023,233; 4,168,562; and 4,369,540.

Thus, it will be seen that there is a great need for an apparatus and method for recovering de-icing liquids from surfaces such as runway surfaces when the de-icing liquid is combined with snow and ice. The present invention solves these problems and permits the effective removal of de-icing liquids from snow or ice-covered surfaces. Further, the present invention permits the recovery of the de-icing liquids in a way that aids economic processing and recycling of the de-icing liquid to recover the glycols therefrom.

SUMMARY OF THE INVENTION

It is an object of the present invention to provide a vehicular apparatus for removal of snow or ice containing de-icing liquids from surfaces such as airport runway surfaces.

It is another object of the present invention to provide a method for the removal of fluids such as snow or ice containing de-icing liquids from runway surfaces to leave such surfaces substantially free of such fluids.

It is still another object of the present invention to provide a two-step process for the removal of fluids such as snow and ice containing de-icing liquids from surface to leave such surfaces substantially free of such fluids.

Yet, it is another object of the present invention to provide a vehicular apparatus capable of traversing surfaces containing fluids such as water, snow or ice and containing de-icing liquids, the apparatus capable of removing such fluids to an environmentally acceptable level.

And yet, it is a further object of the present invention to provide motorized equipment for traversing surfaces containing fluids such as water, snow or ice containing de-icing fluids to remove such fluids at temperatures well below water freezing temperatures.

These and other objects will become apparent from the drawings, specification and claims appended hereto.

In accordance with these objects, there is provided a vehicular apparatus adapted for removing fluids including snow and de-icing liquids from a surface as the apparatus traverses the surface. The apparatus comprises: a first container for depositing a first portion of the fluids removed from a zone of the surface; means for collecting and transferring the first portion of the fluids from the zone to the first container; a second container for collecting residual fluids remaining on the zone of the surface after the first portion is removed; means positioned for impinging high pressure water on the zone of the surface to loosen the residual fluids or make them airborne; and means in communication with the second container for drawing or sweeping the loosened residual fluids and water into the second container concurrently with impinging high pressure water on the surface.

DETAILED DESCRIPTION OF THE PREFERRED EMBODIMENTS

Figure 1:
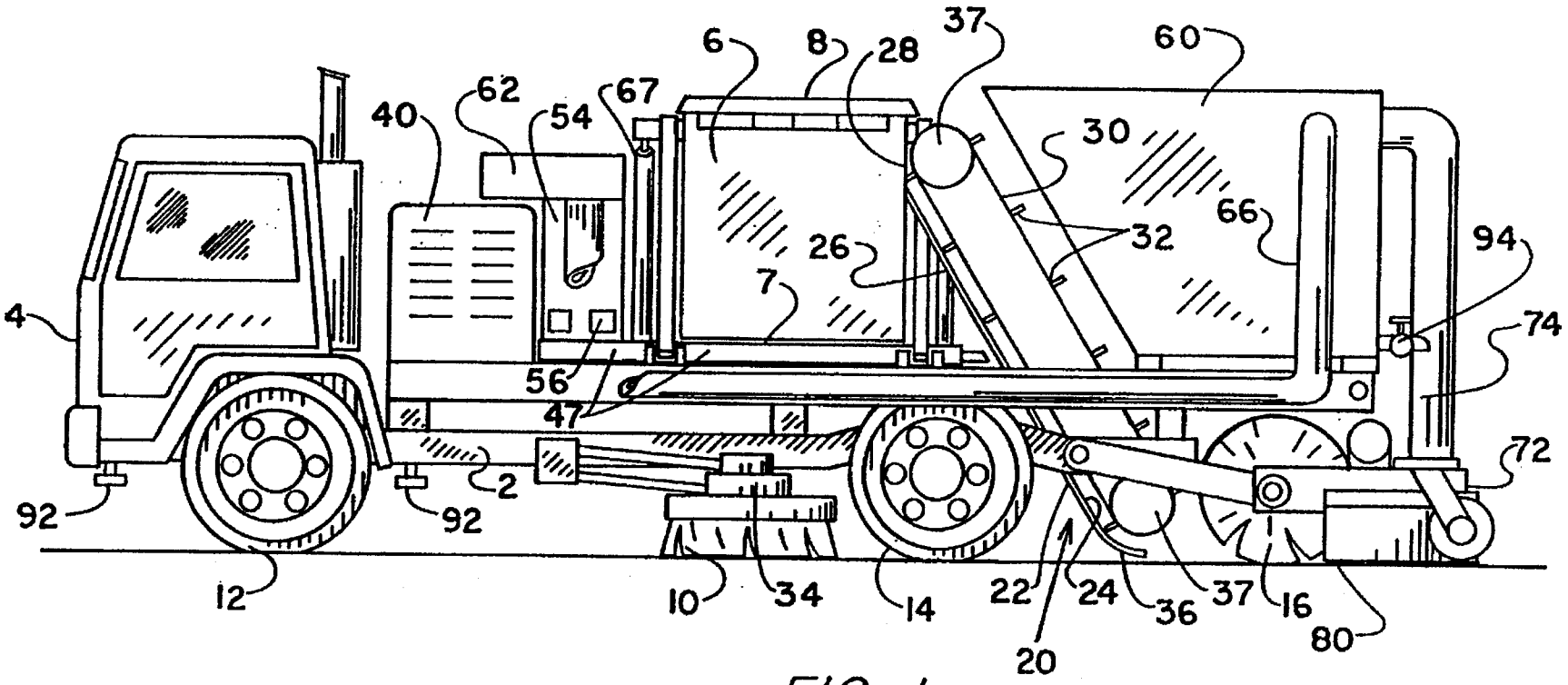
FIG. 1 is a side elevation view illustrating a vehicular apparatus of the invention.

Referring now to FIG. 1, there is shown a schematic of a vehicular apparatus suitable for removing fluids such as snow and de-icing liquids in accordance with the invention. The apparatus is shown mounted on the bed or frame 2 of a truck 4 for purposes of moving the apparatus across the surface to be treated. However, the apparatus may be mounted on a trailer and towed across the surface to be treated.

The apparatus comprises a number of components which work in cooperation to remove snow and/or ice and de-icing liquid from the surface of an airport runway at temperatures below freezing. The apparatus has the ability to leave the surface of the runway substantially dry and free of snow, ice and de-icing fluids or other contaminants. This is a very important feature of the invention because a residual coating of ice on the surface would still act to entrap de-icing fluids and other contaminants. With respect to de-icing liquid, it is important that such liquids be removed to a very low level. Thus, the de-icing liquid should be removed to a level of less than 30 mg/100 square centimeters, and preferably 5 mg/100 square centimeters of runoff water. That is, water that runs off the runway surface should not contain more than these levels of de-icing liquid.

Often, these levels of de-icing liquid are mandated by governmental regulations to avoid pollution or environmental problems. Because of the regulations, the combination of snow, ice, de-icing liquid and freezing temperatures provide a unique removal challenge, particularly when the newer de-icing liquid (Type II) is used that has greater ability to cling to surfaces. Additionally, the challenge is increased further by the fact that it is desirous to remove the snow, ice, and de-icing liquids in one pass to leave the runway surface clean and free of obstructions. This minimizes interference with planes taking off and landing.

The present invention can achieve this level of removal in a single pass. Basically, removal is achieved by a combination of sweeping and impinging water on the runway surface at a controlled pressure after it is swept. Concurrent with the impinging, an air sweep is used to remove airborne constituent. All of these steps occur at the same time and are dependent on each other to provide effective removal. Additionally, to provide a substantially dry surface on the runway after spraying and to facilitate the air sweep step, the surface is contacted with a wiper blade such as a squeegee-type blade as a last operation. This has the effect of containing sprayed water and residual de-icing liquids for removal during the air sweep operation.

Having thus described the steps of the operation in general, the invention will now be described in detail. It should be noted that the vehicular apparatus operates in two general stages, the first of which involves the sweeping operation. Referring to FIG. 1, there is shown a somewhat schematic representation of the vehicular apparatus comprising a truck chassis having mounted thereon a first container 6 for receiving materials such as snow, slush, de-icing liquid mixed therewith and debris such as sand that may be mixed with the snow. To facilitate removal of such materials, sweeping brooms in the form of rotary brushes 10 are provided. In the embodiment shown in FIG. 1, rotary brushes 10 sweep snow, etc., towards the center of truck chassis 2 (FIG. 2) having front wheels 12 and rear wheels 14. The rotary brushes 10 are mounted between the front and rear wheels. It will be appreciated that rotary brushes 10 may be mounted forward of front wheels 12. Also, means other than the brushes, e.g., snow plow blades or cylindrical brooms, may be used instead of rotary brushes 10 or in combination therewith to move snow as noted.

Figure 2:
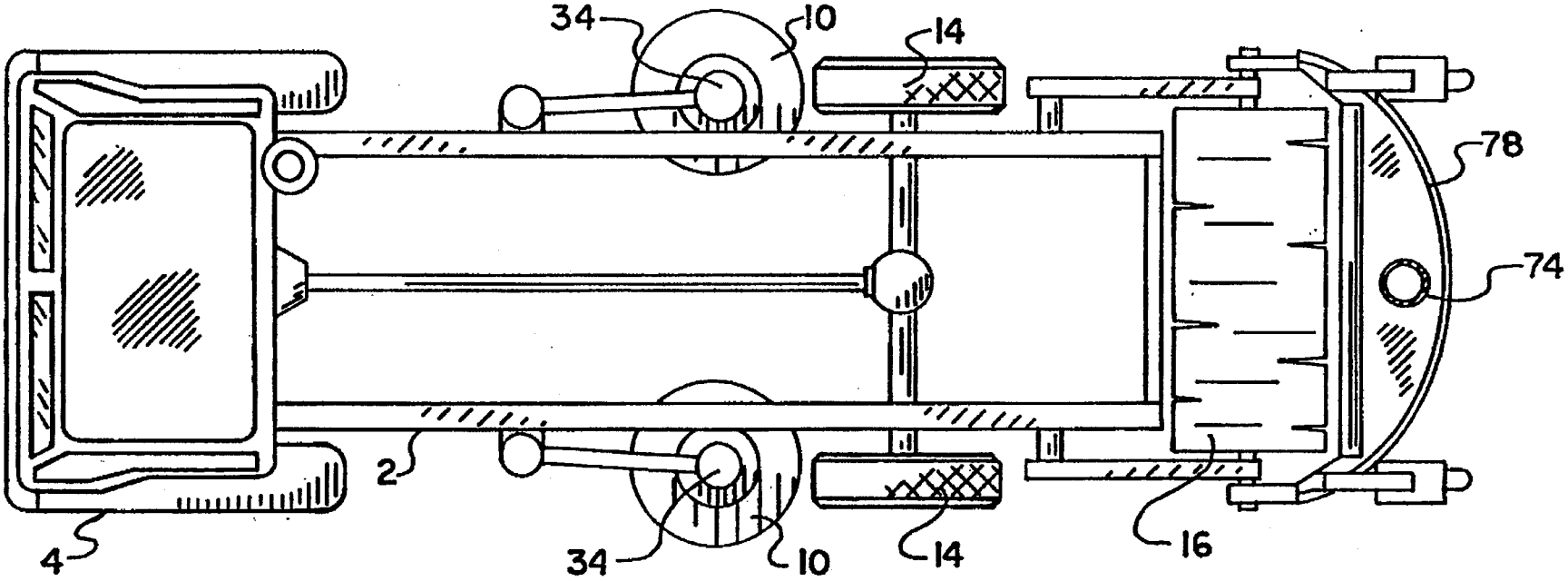
FIG. 2 is a plan view illustrating the location of rotary brushes on the vehicular apparatus.

After the snow and other materials have been moved towards the center of the truck chassis, it must be transported into first container 6. This is achieved by cylindrical brush 16 that rotates to sweep or brush snow onto transport elevator 20. Cylindrical brush 16 and transport elevator 20 have a width approximately the width between rear wheels 14 and are of sufficient width to remove snow and ice swept in by rotary brushes 10 (FIG. 2).

Transport elevator 20 is comprised of a sheet or plate 22 of rigid material having a surface 24 on which snow slides easily. Plate 22 has an upper end 26 that projects through a sidewall 28 of container 6 as shown in FIG. 1. Also, plate 22 has lower end 36 that extends towards brush 16 to provide a ledge on which snow and slush is placed for moving up incline plate 22. Transport elevator 20 further comprises a belt 30 mounted on rollers 37. Belt 30 has blades or elevator squeegees 32 which extend to plate 22 and cooperate therewith to move snow, slush and other materials up plate 22 and into container 6. For purposes of efficiency in moving materials on plate 22, blades or elevator squeegees 32 should be in contact with the surface of plate 22 to provide wiping action. Further, plate 22 can be provided with side dams (not shown) to prevent material from escaping from the pocket formed by the elevator squeege and the plate surface. Thus, for purposes of moving snow and slush upwardly on plate 22, belt 30 rotates to move blades or elevator squeegees 32 up plate 22 where the snow and slush are discharged into container 6.

For purposes of lifting or lowering rotary brushes 10, cylindrical brush 16, and transport elevator 20, means is provided, such as hydraulic means, for moving such into a sweeping position or retracted position. In addition, hydraulic pump means (not shown) can be utilized to drive hydraulic motors 34 to turn rotary brushes 10. Also, such hydraulic pump can be used to turn cylindrical brush 16 and raise or lower transport elevator 20.

For purposes of removing snow and slush, the vehicular apparatus can move across the surface at a speed of 6 mph, for example. Lower or higher speeds can be achieved, if desired. It will be appreciated that the rate of rotation of brushes 10 and 16 as well as belt 30 can be adjusted to suit the speed at which the equipment traverses the surface and the amount of snow, slush and debris to be removed from the surface. Brushes 10 rotate at a speed of 30 to 60 RPM, and brush 16 rotates at a speed of 150 to 300 RPM. Further, belt 30 typically rotates at 150 RPM.

Figure 3:
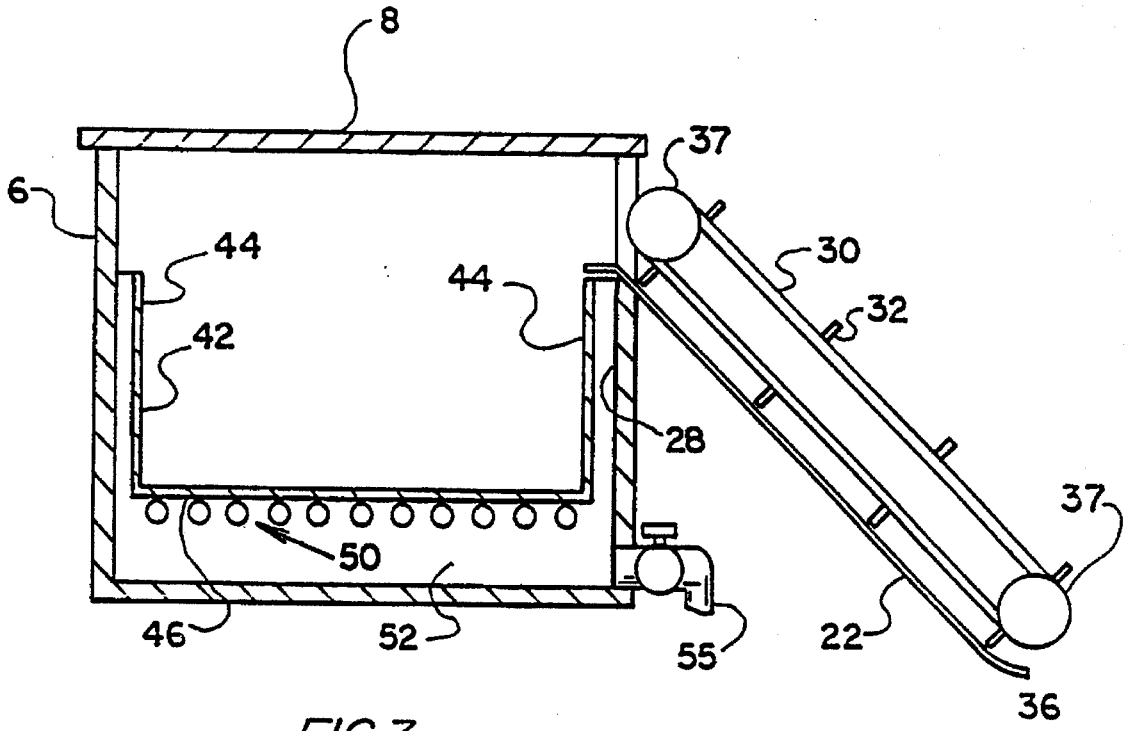
FIG. 3 is a cross-sectional view illustrating a first or forward container on the vehicular apparatus suitable for collecting snow and de-icing liquid.

Referring now to container 6 (FIG. 3), there is shown a cross-sectional view showing a mesh filter 42 which is provided to filter out debris such as sand, rocks and the like from melted snow, ice and de-icing fluids. Preferably, the filter forms a box-shaped plenum with the walls of container 6. Further, the filter can be pre-fabricated, placed in container 6 and supported by fasteners (not shown) that fasten sidewalls 44 to the sidewalls of container 6. Filter 42 has four walls 44 and bottom 46 and may be fabricated out of any material suitable for the filtering operation. Typically, such filter may be fabricated from a nylon or a polyester material such as KEVLAR® available from DuPont. The filter material may be provided with a polyvinyl chloride coating to minimize adhesion of particles of dirt. Typically, the filter has rectangular shaped openings to improve the filter efficiency and a mesh size of about 17(long side)×12 (short side) mesh per square inch.

In addition, there can be provided in container 6 heating means 50 located below filter 42 which may be any heating means for melting snow and slush at a sufficient rate to keep container 6 sufficiently empty to accommodate snow as it is introduced. Heating means 50 can be an electric resistance heating element supplied by a generator powered by engine 40. Alternatively, the heating means may be hot water circulated through pipes located below filter 42. Or, the heating means can comprise hot air circulated through heat exchanger tubes located in container 6. The air can be heated in a heat exchanger receiving exhaust gases from auxiliary engine 40. Additionally, hot air can be impinged upon transport elevator 20, preferably the underside of plate 22 of transport elevator 20, to initiate melting prior to entering container 6. For purposes of the present invention, preferably, a heat exchanger 47 (FIGS. 1 and 10) for heating container 6 can be located underneath floor 7 of container 6 in close proximity therewith so as to provide efficient heat transfer thereto. Thus, floor 7 can rest or even touch a surface of heat exchanger 47. As noted earlier, heat exchanger 47 can be heated utilizing exhaust gas from auxiliary engine 40.

Figure 6:
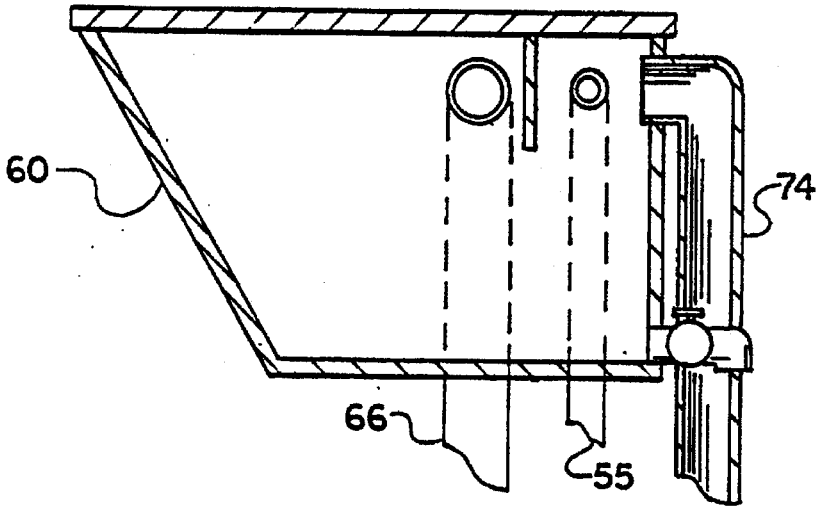
FIG. 6 is a cross-sectional view of a second container of the vehicular apparatus.
Figure 10:
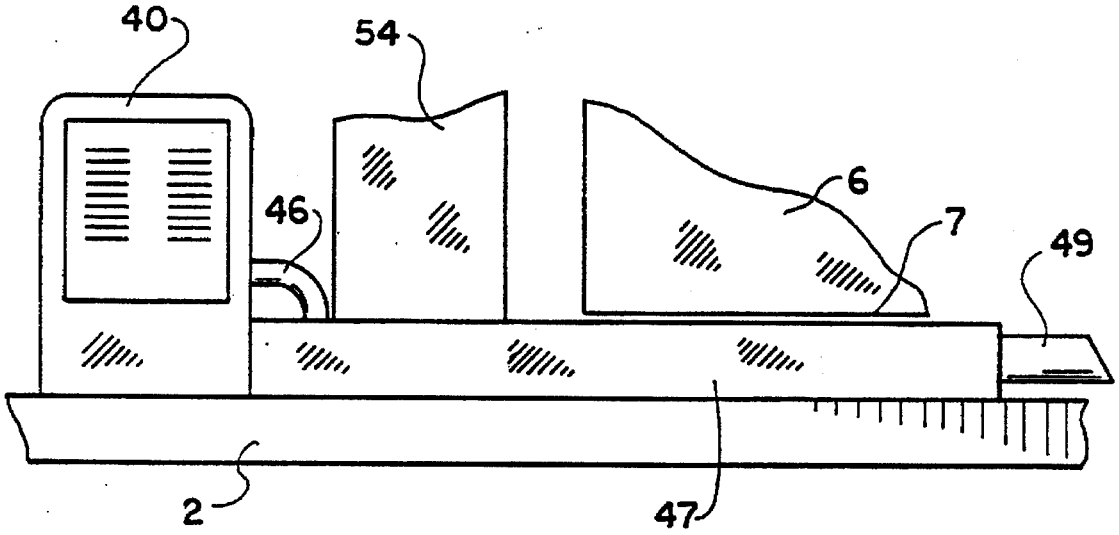
FIG. 10 shows a heat exchanger that utilizes exhaust gases to melt snow and ice.

After such gases have passed through heat exchanger 47, the gases may be impinged on bottom plate 22 of transport elevator 20, as noted, to initiate melting of snow and ice as it is transported into container 6. In FIG. 10, heat exchanger 47 includes tubes 49 located under floor or bottom 7 of container 6. Exhaust gases can enter heat exchanger 47 through conduit 46 from auxiliary engine 40 and exit heat exchanger 47 to impinge on plate 22 of transport elevator 20, as noted. Any snow and/or ice introduced to container 6 is melted by heating means 50. Liquid from melted snow, etc., passes through filter 42 into plenum 52. The liquid is pumped from plenum 52 of container 6 along piping 55 to storage tank 60 (FIG. 6).

Container 6 may be provided with a high volume pump for loading liquid directly into container 6. Such a pump is particularly useful when pools of liquid have accumulated on the runway surface. As will be appreciated, such pools of liquid are not amenable to loading by means of transport elevator 20. If container 6 is used as a storage container when storage tank 60 is full, then the high loading pump can be reversed and used for purposes of unloading container 6.

Container 6 also has means for unloading sand and debris collected on filter 42. In reference to FIG. 8, vehicular apparatus 4 is shown having first container 6 elevated by hydraulic means 67 and tipped or rotated to open lid 8 which also serves as a chute to remove sand or other debris from container 6 to a suitable collection area. A hydraulic mechanism (not shown) may be used to open lid 8 after container 6 has been tipped to the desired position. Further, when container 6 is tipped the filter contained therein is easily washed or cleaned by use of high pressure water directed against the filter surfaces.

It should be noted that the operation performed by rotary brushes 10 and 16 normally remove about 70% of liquids, ice, snow, slush, etc., and other debris such as sand from the surface of the runway. De-icing liquid contained in the snow, ice and slush is removed therewith. However, substantial residual de-icing liquid and ice may remain on the surface. The residual de-icing liquid remaining on the surface can be combined with the ice or snow layer remaining after the first sweeping action. Also, the residual de-icing liquid can reside underneath the ice and snow layer in cracks and crevices and other low spots in the surface. It is this residual de-icing liquid that is very difficult to recover, particularly to a level that is environmentally acceptable. Thus, there is provided means 70 for loosening the residual snow, ice and de-icing liquid and transferring it into storage tank 60.

Figure 4:
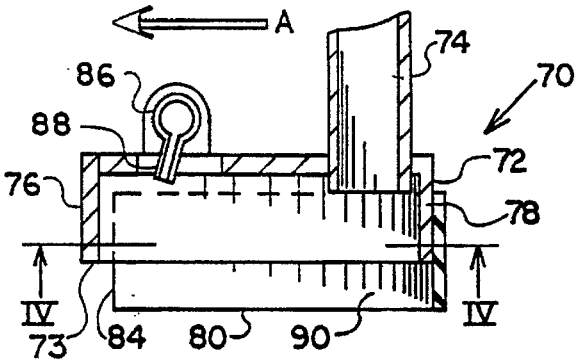
FIG. 4 is a cross-sectional view illustrating a box-shaped head in which water is impinged on the surface and through which air is swept to remove residual fluids from the surface.

Referring to FIG. 4, where forward motion is indicated by a bold arrow A, there is shown means 70 for loosening residual snow, ice and de-icing liquid. By the term "loosen or loosening" as used herein is meant that residual snow, ice and de-icing fluids are broken up into very small pieces that may be substantially melted and become airborne as a result of high pressure water being impinged or being directed onto the surface of the runway. Means 70 comprises a head 72 connected via a tube 74 to storage tank 60. Head 72 has a forward wall 76 that preferably can be raised or lowered to control air flow to provide the required air sweep depending on conditions as explained later. Forward wall 76 is located adjacent to and following brush 16, based on the forward motion of the vehicular apparatus. Forward wall 76 provides an opening 84 (see FIG. 7) that is defined by a bottom edge 73 of forward wall 76 and the surface from which snow and ice, etc., are to be removed. Forward wall 76 is positioned to provide an opening 84 having a height ranging about 2 to 8 inches, preferably 4 to 6 inches, from the surface being treated.

Head 72 has a rear wall 78 for contacting runway surface 80. Further, head 72 has side walls 82 connecting forward wall 76 to rear wall 78. Preferably, side walls 82 extend sufficiently close to surface 80 to minimize escape of liquid from head 72, as the vehicular apparatus traverses the surface of the runway.

Forward wall 76 may be mounted by means such as adjusting bolts in slots (not shown) that permit adjustment up or down to allow snow and slush to enter head 72 without restricting air flow or forward wall 76 may be raised or lowered by hydraulic means.

Figure 7:
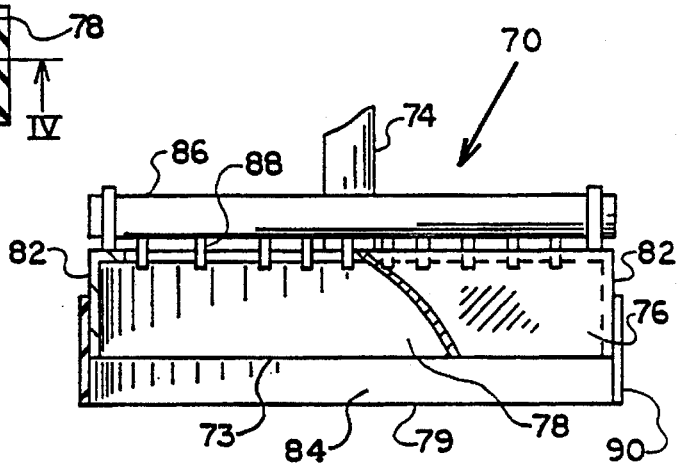
FIG. 7 is a front view of the box-shaped head that employs nozzles to impinge water at high pressure on the runway surface and an air sweep to remove airborne materials from the runway surface.
Figure 5:
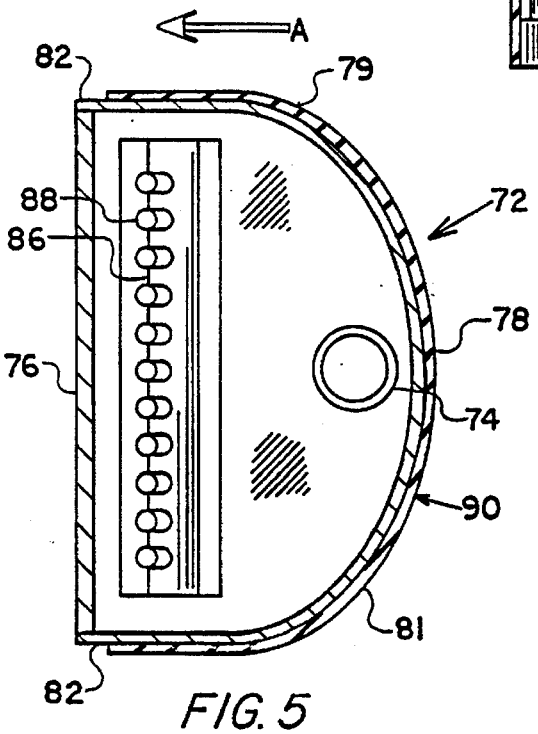
FIG. 5 is a cross-sectional view along the line IV—IV of FIG. 4.

For purposes of removing residual snow, ice and de-icing liquid remaining on the runway surface after the above initial cleaning, high pressure water is impinged on and directed at the surface through a spray bar 86 and nozzles 88 (see FIGS. 4, 5 and 7). Nozzles suitable for use on spray bar 86 can be obtained from John Brooks Company, Ltd., Mississauga, Ontario, Canada, under the designation TP11001TC, TP1100080TC, TP1100067TC, 11350S (with Jet Stabilizer 303SS) and TP8001TC (with Flat Spray Tip).

Water for impinging on the surface is provided in water tank 54 (FIG. 1) and is carried through tubing 59 (FIG. 9) connected to spray bar 86. The water can be heated in the same manner as described for container 6. The water in tank 54 may be heated by an auxiliary heater. For example, cooling liquid from engine 40 may be passed through a heat exchanger (not shown) located in the water in tank 54 before being returned to the radiator of engine 40. This method can operate to heat water in tank 54 up to 200° F. Preferably, the water is heated to a temperature in the range of about 60° to 190° F. and typically 100° to 150° F.

Spray bar 86 extends across the width of the surface 80 to be treated. Typically, spray bar 86 has the nozzles spaced about 8 inches. Further, the nozzles are mounted to impinge water on the surface at an angle in the range of 70° to 20° from a plane vertical to the surface. Preferably, the nozzles are mounted to direct water in the direction of travel. Thus, it is preferred that spray bar 86 is rotatably mounted to provide the desired angle. At higher temperatures of operation, e.g. 32° F., the angle can be greater because the water impinged on surface 80 can have longer contact time before freezing. At colder temperatures, it is preferred that the angle is smaller in order to impinge water closer to rear wall 78 which acts as a squeegee, as discussed in detail hereinafter. In this way, water impinged on the surface has a very short contact time. Such an operation minimizes water freezing on the surface prior to being removed.

Figure 11:
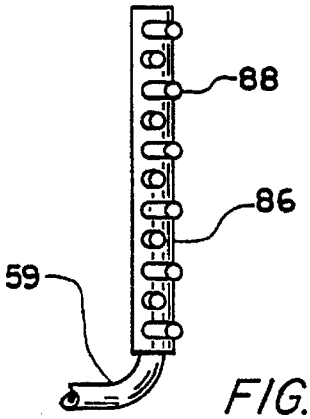
FIG. 11 shows staggered nozzles on a spray bar in accordance with the invention.

While nozzles 88 are shown in a straight line on spray bar 86, in one aspect of the invention it is preferred that the nozzles be positioned in a staggered arrangement, for example, as shown in FIG. 11. The staggered arrangement provides for a cleaner surface. That is, in certain instances when the nozzles are positioned in a straight line the outer edges the fan of water emanating from the nozzle can act deleteriously on the fan of water emanating from the adjacent nozzle to reduce the force with which the outer edges of the fan strike the surface. This can result in residue remaining on the surface coinciding with the area between the nozzles. However, the staggered nozzle arrangement as shown in FIG. 11, for example, substantially eliminates the residue by permitting outer edges of the fan of water from adjacent nozzles to stride the surface without interference. In another arrangement, the nozzles can remain in a straight line and arranged so that the fans of water emanating therefrom overlap.

Water is impinged on the surface at pressures ranging from about 500 to 10,000 psi, and typically at pressures in the range of 2,000 to 4,000 psi. Higher pressures are useful at colder temperatures and when the residual is more difficult to remove from the surface. A high pressure pump (not shown) for delivering water to the nozzles from water tank 54 may be located under tank 54 in a compartment 56 that is heated to prevent water in the pump from freezing.

In the present invention, it is important to control the amount of water being applied to surface 80. That is, if too much water is applied, subsequent processing to recover glycols therefrom can be uneconomical. Thus, it is preferred to minimize the amount of water impinged on the surface. For purposes of the present invention, it is preferred that water flows from the nozzles at a rate in the range of 0.7 to 1.2 gals/min/nozzle and typically 0.9 to 1 gals/min/nozzle.

Because the temperatures of the removal process can be sub-zero, all the piping, including piping conveying water to the nozzles, are preferably heated.

The water applied through nozzles 88 is used to loosen the snow, ice and de-icing liquid and make them airborne. Once this residual material is airborne, it is conveyed into storage tank 60.

In accordance with this embodiment of the invention, an air sweep means is used to carry the airborne material into storage tank 60. The air sweep means may be enabled by applying a vacuum to storage tank 60. The air sweep means flows air at about 8,000 to 20,000 CFM through opening 84 (defined by bottom edge 73 of forward wall 76 and runway surface 80), with a typical flow rate being in the range of 12,000 to 18,000 CFM. Alternatively, the air sweep should be able to flow air at a rate of about 1,000 to 2,000 CFM per foot across the width of the head device. It is preferred that storage tank 60 be maintained at sub-atmospheric pressure while maintaining the air sweep therethrough. The vacuum condition or sub-atmospheric pressure condition may be maintained by a positive displacement vacuum pump or a fan operated to induce a negative pressure in tank 60 or a combination of positive displacement pump and fan. Positive displacement vacuum pumps are generally not preferred because they normally do not permit sufficient air sweep for purposes of the present invention. Further, because of the low air sweep and high vacuum experienced with positive displacement vacuum pumps, severe cooling can be encountered in tank 60 because of the reduction in pressure. This often leads to freezing of water, particularly in tube 74 and the shutting down of operation. Thus, the air sweep and vacuum in container 60 should be balanced to avoid the freezing conditions. Accordingly, container 60 should be maintained at a vacuum in the range of 0.005 to 0.5 atmospheres, typically 0.01 to 0.05 atmospheres, while operating at the air sweep conditions referred to. For purposes of the present invention, it has been found that the freezing conditions are avoided when a vacuum fan 62 is used as described to maintain the reduced pressure in container 60 and the air sweep referred to.

It is understood that the flow rate of air through opening 84 and the pressure of water flowing from nozzles 88 should be controlled. That is, the pressure of water at the nozzles must be sufficient to overcome the force of the air sweep and to permit the water to impact the surface with sufficient energy to cause residual materials, e.g., snow, ice and de-icing liquids, to become airborne. This feature of the invention is important in order to carry the airborne snow, ice and de-icing liquid (mostly in the form of finely divided water or liquid) in the air sweep into storage container 60.

For purposes of enabling the air sweep, a vacuum fan 62 is connected to storage tank 60 via tube 66 (see FIGS. 1 and 6) which may be powered by a hydraulic motor (not shown) driven by engine 40. The vacuum fan pulls air through opening 84 provided by bottom edge 73 of forward wall 76 and carries airborne snow, ice and de-icing liquid through conduit 74 into storage container 60. Conduit 74 should extend a sufficient distance into storage tank 60 to avoid direct access to conduit 66 connected to vacuum fan 62, thereby ensuring separation of air from water and/or snow, ice and de-icing liquid. In place of vacuum fan 62, a blower may be used, particularly where higher horsepower requirements are necessary. By the term "vacuum fan" is meant a fan that is capable of producing a negative or sub-atmospheric pressure on container 60 by drawing air therethrough from head device 70 along tube 74. In drawing air through container 60, an air sweep is created that enters through opening 84 in head device 70. Tube 74 becomes the control or throttle for air entering container 60. By the term "air sweep means" as used herein is meant any device such as the positive displacement vacuum pump, vacuum fan, blower or combination of these that can operate to produce the air flow or sweep and the sub-atmospheric conditions referred to. A vacuum fan suitable for use in the present invention is available from Haul-All Equipment, Ltd., Lethbridge, Alberta, Canada, under the designation VG-3300FX-1.

Figure 9:
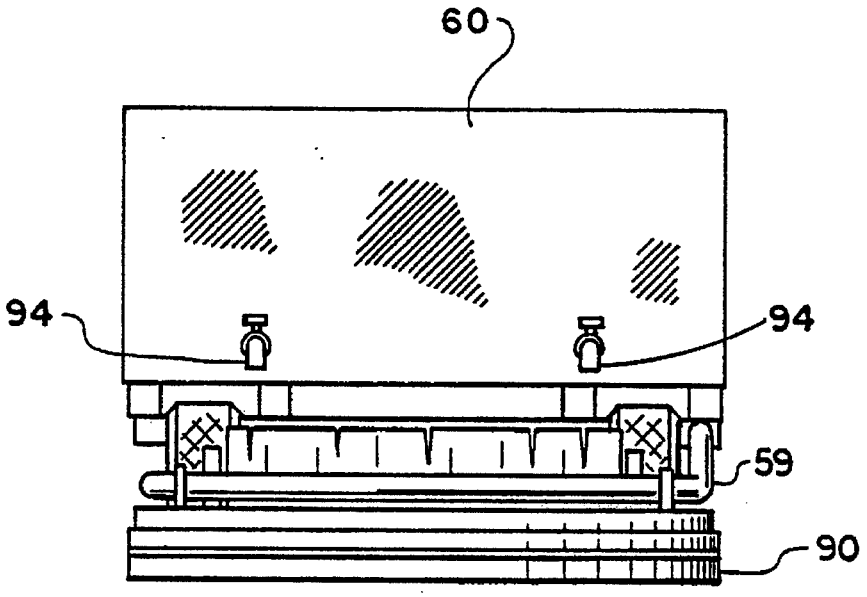
FIG. 9 is a rear view of the vehicular apparatus illustrating the head and blade for wiping residual liquid from the runway surface.

Even though the air sweep operates to carry a substantial amount of airborne materials into storage tank 60, residual water remains on the runway surface and must be removed because it contains de-icing liquid. Also, the residual water can freeze and leave icy patches. Thus, preferably rear wall 78 comprises a wiper blade or squeegee 90 (FIG. 4) which operates to contain water in the area defined by the walls of head 72. Further, preferably rear wall 78 has an oval or circular shape (as shown in FIGS. 5 and 9) wherein outer portions 79 and 81 sweep forward and extend forward of conduit 74 (see bold arrow for direction). This configuration pushes water on the surface towards the location of conduit 74 to facilitate removal as the water becomes airborne.

Figure 12:
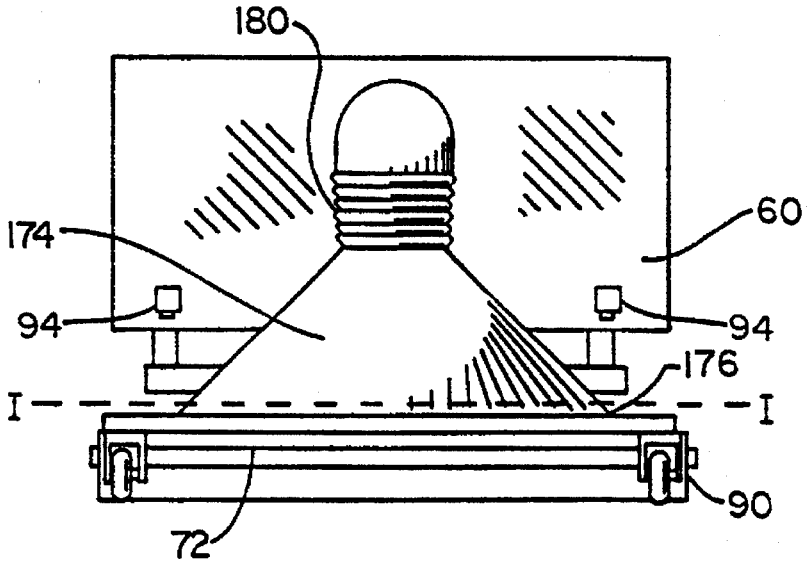
FIG. 12 shows a rear view of another embodiment of the vehicular apparatus of the invention.
Figure 13:
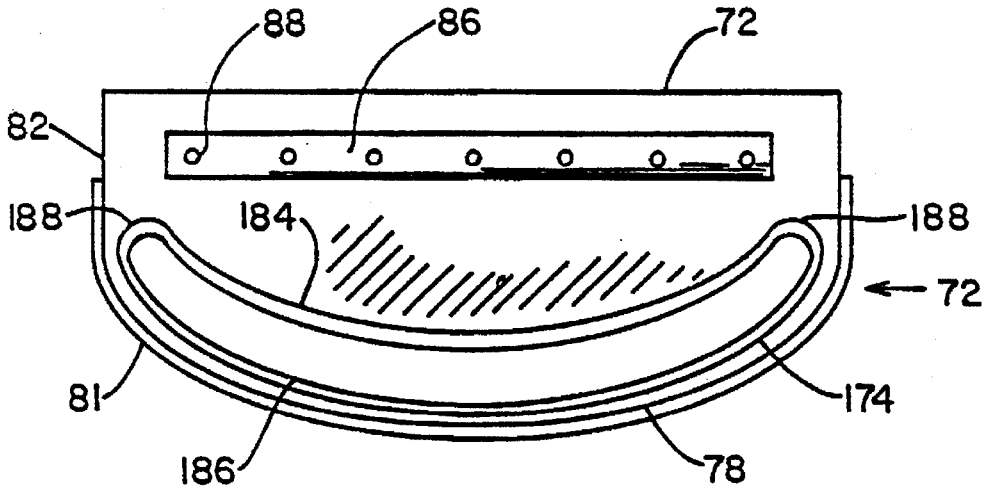
FIG. 13 shows a cross-sectional view of conduit taken along line I—I of FIG. 12.
Figure 14:
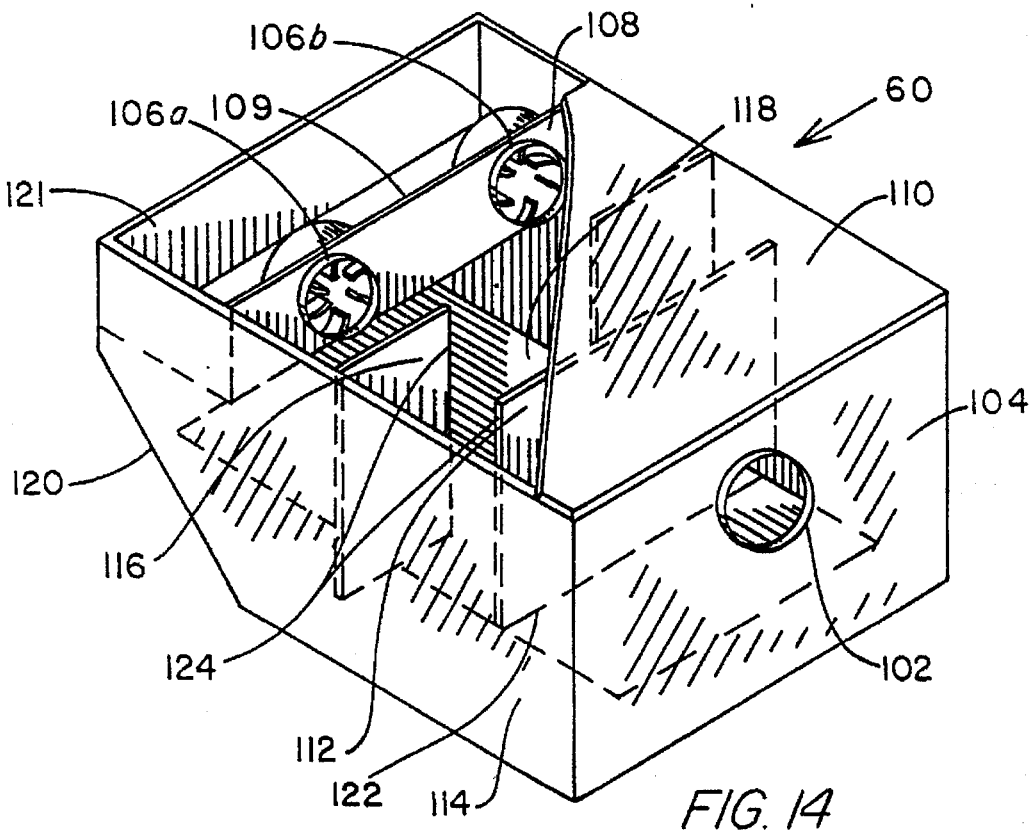
FIG. 14 shows a perspective view illustrating a container and baffles therein for collecting fluids in accordance with the invention.

In another embodiment of the invention, it has been found that removal of airborne material is improved when conduit or tube 74 is shaped to conform with the shape of rear wall 78 of head 72 as shown in FIGS. 12, 13 and 14. It has been discovered that utilizing a conduit having a concave, triangular shape, as shown in FIG. 12, a constant velocity of air and airborne materials along the conduit can be obtained. Having uniform velocity along the conduit prevents buildup of ice or snow in conduit 174, and thus, no change is experienced in removing snow, ice and de-icing liquids from the runway or apron surface.

Referring now to FIG. 12, there is shown a rear view of the vehicular apparatus illustrating head 72, blade 90 and conduit 174. In FIG. 12, it will be seen that conduit 174 has an extent 176 adjacent head 72 that encompasses a large part of the width of head 72. Thus, preferably conduit 174 has an extent 176 that traverses at least half the effective width of head 72. If desired, several conduits having this configuration may be used to traverse the effective width of head 72. Further, conduit 174 is generally triangular shaped as it tapers to a tubular opening to enter tank 60. Conduit 174 forms a substantially circular opening 180 that connects to a tube entering tank 60.

Referring to FIG. 13, there is shown a cross-sectional view of along the line I—I of FIG. 12 showing the configuration of conduit 174 as it opens into head 72. Conduit 174 has a concave front wall 184 and a concave rear wall 186 joined at the ends 188. Preferably, ends 188 are circular shaped. Further, preferably walls 184 and 186 are provided with curvature similar to that of rear wall 78. As noted, it is this configuration that provides for uniform velocity along the direction of flow and prevents accumulation of ice or snow with its attendant problems. Preferably, conduit 174 has a cross-sectional area that remains substantially constant along the length of the conduit. Thus, the velocity of materials through the conduit remains substantially constant preventing buildup of materials such as ice or snow. Further, utilizing a conduit having an extent that traverses a substantial portion of the head as shown in FIG. 13 results in efficient removal of fluids such as water, ice, etc. from the surface.

In another embodiment of the invention, there is provided a preferred storage tank 60 as shown or illustrated in FIG. 14. Storage tank 60 is provided with a circular opening 102 through which conduit 174 transfers water, ice or snow to the storage tank. For purposes of maximizing the capacity of storage tank 60, opening 102 is located in the upper region of wall 104 of storage tank 60. In addition, for improving the efficiency of the air sweep through tank 60 to remove water, ice, snow, etc., from the surface, vacuum fans 106A and 106B are provided in a wall 108 substantially opposite wall 104. Wall 108 along with bottom wall 109 seals vacuum fans 106A and 106B from the inside of tank 60. The box-shaped recess defined by walls 108 and 109 is open in the top and is thus effective in diverting air upwardly and away from equipment and personnel. However, vacuum fans 106A and 106B may be located or positioned on wall 121 and walls 108 and 109 can be eliminated. Again, for purposes of maximizing the capacity of storage tank 60, vacuum fans 106A and 106B are mounted as close as possible to top wall 110.

Because of the high flow rates employed in the air sweep, it is important to ensure separation of fluids such as water, ice, mist, etc., from the air sweep to avoid pulling such materials into the vacuum fans. Thus, in container or tank 60, there is provided a first baffle 112 extending from top wall 110 downwardly, preferably below opening 102. Further, preferably first baffle 112 does not extend to sidewalls 114 but leaves an opening between either sidewall 114 and baffle 112. Thus, air sweep carrying water, ice, mist, etc., entering through opening 102 is diverted towards the side walls. This change in direction permits water, ice, etc., to drop out of the air sweep. Thus, particles of water, ice, etc., are not drawn into vacuum fans 106. Additionally, a second set of second baffles 116 are provided in tank 60. Second baffles 116 are mounted between first baffle 112 and vacuum fans 106A and 106B. The second baffles extend outwardly from sidewalls 114, preferably beyond the entrance into vacuum fans 106A and 106B substantially as shown in FIG. 14. Further, second baffles 116 as well as being connected to sidewalls 114 are connected to top wall 110. Thus, air sweep which is diverted by first baffle 112 is once again diverted by second baffles 116.

A third baffle 118 may be provided as shown in FIG. 14. Third baffle 118 is a substantially flat plate that extends from rear wall 104, below opening 102, to front wall 120. Preferably, third baffle 118 contacts bottom 122 of first baffle 112 and edges 124 of baffles 116. Having baffles arranged in tank 60, as shown in FIG. 14, provides a tortuous path for the air sweep, and water, ice, etc., contained therein is effectively dropped out of the air sweep. Thus, vacuum fans 106A and 106B can be operated to provide a very high velocity air sweep with freedom from entraining water, ice, mist, etc. It will be understood that opening 102 or vacuum fans 106A and 106B may be located on other walls. For example, opening 102 or vacuum fans may be mounted on top wall 110. However, the baffling or mist eliminators should be re-arranged to prevent entrainment.

Figure 15:
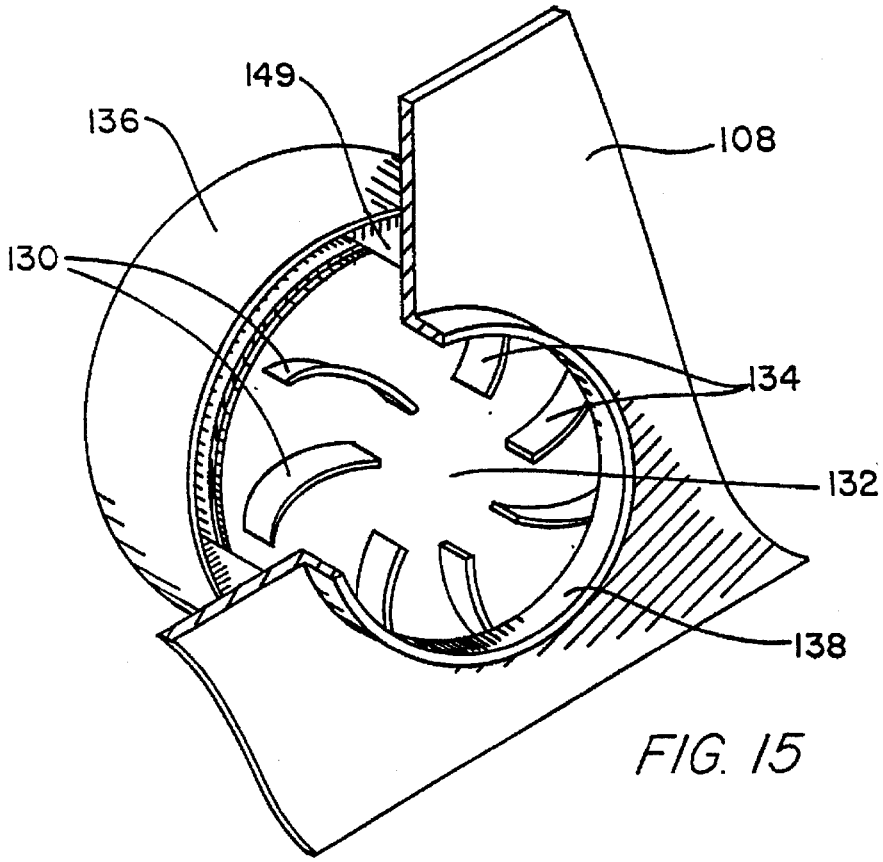
FIG. 15 shows a wall section of the container in FIG. 14 and an illustration of a vacuum fan with curved blades attached thereto.
Figure 16:
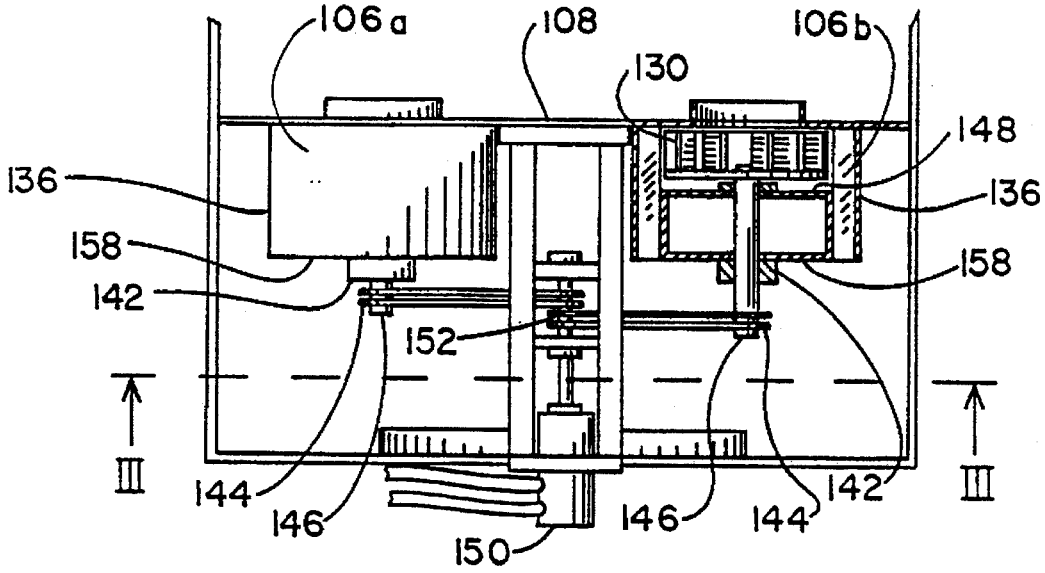
FIG. 16 shows a top view of the vacuum fans employed in FIG. 14.
Figure 17:
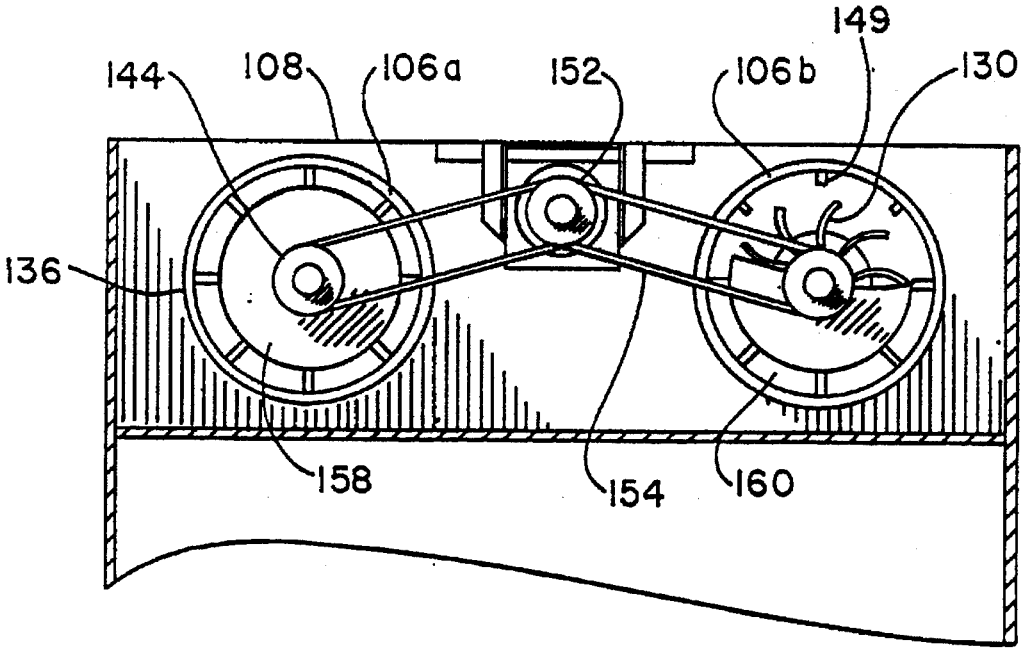
FIG. 17 shows a side view of vacuum fans taken along line III—III of FIG. 16.

Because of the high air flow rates required for effective removal of water, ice particles, liquid, etc., it is important that such air flow rates be maintained even in high loading of water, snow or ice. A vacuum fan design particularly suitable is shown in FIGS. 15, 16 and 17. In FIG. 15, there is shown a section of wall 108 and an illustration of a vacuum fan 106 that has curved blades 130 mounted on a plate 148. As blades 130 are turned in a clockwise direction, air enters through opening 138 axially to center portion 132 and is then propelled radially by surface 134 of curved blade 130. Opening 138 has a smaller diameter than the diameter across blades 130. The air then comes in contact with housing 136 and flows rearwardly out of housing 136. Vanes 149 may be utilized to direct the flow of air rearwardly out of fan 106.

FIG. 16 shows a top view of the vacuum fans employed in FIG. 14. In FIG. 16, there is shown housing 136 having wall 158 carrying bearing 142 and pulley 144. Axle or spindle 146 that carries blades 130 and mounting plate 148 is shown mounted through bearing 142. Mounting plate 148 and fan blades 130 are shown in a cut away housing of vacuum fan 106B. Mounting plate 148 is shown attached to spindle 146. Located between vacuum fans 106A and 106B is a vacuum fan drive mechanism 150 having two pulleys 152 for driving the respective vacuum fans.

In FIG. 17, there is shown a side view of vacuum fans 106A and 106B taken along the line III—III of FIG. 16. In FIG. 17, vacuum fan 106A is shown enclosed in a housing comprising housing 136 and 158. Pulley 144 is shown connected to pulley 152 by belt 154. In vacuum fan 106B, a cut away section has been provided to show the location of blades 130. Thus, in operation, air from tank 60 enters vacuum fan 106A and 106B axially and is expelled radially toward wall 136. The air then changes direction again and exits in an axial direction. Wall 158 is provided with a circumferential slotted opening 160 defined by vanes 149 (see FIG. 17) to permit expulsion of air.

It will be appreciated that blades 130 are curved in accordance with the amount of air to be passed through the vacuum fan and the speed at which the vacuum fan is to be operated. It is this configuration of vacuum fan that operates efficiently without air stall and thus has been discovered to be very effective in maintaining the required air sweep to remove water, ice, etc. under all kinds of adverse conditions. However, straight blades may be employed but are believed not to operate as efficiently.

In removing snow, ice and de-icing liquids from airport surfaces, it is not uncommon to encounter oils, such as hydraulic fluids, and grease. Oils and grease are undesirable in the present invention because they tend to stick to surfaces and result in a build-up of residue in tube 74 and tank 60 that is difficult to remove. Thus, to minimize such buildup of oil and grease, an emulsifier may be applied to the surface prior to removal of snow, ice and de-icing liquids. An emulsifier such as K99 available from Flexo Products Limited, Niagara Falls, Ontario, Canada, has been found to be suitable and may be sprayed through nozzles 92.

Figure 8:
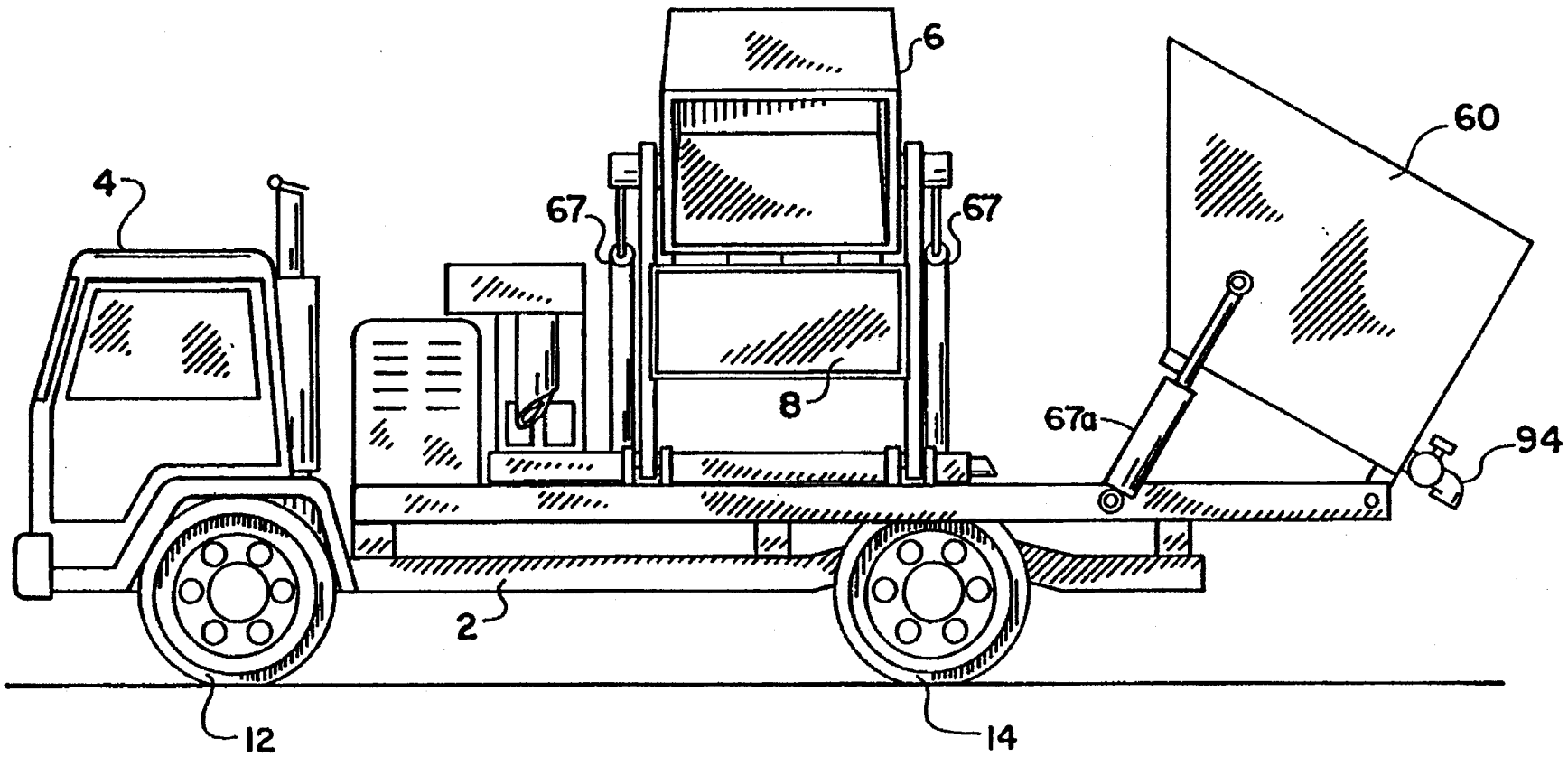
FIG. 8 is a side elevational view of the vehicular apparatus showing containers in a position for dumping contents therefrom.

When container 60 becomes full, liquid can be discharged through discharge ports 94 (FIG. 9). Further, because sand and other material can be carried with the airborne material, container 60 can be tipped as shown in FIG. 8. This facilitates removal of liquid and other debris such as sand, for example by water spray or gravity. Container 60 can be provided with a floor which slopes towards discharge port 94 to avoid the need for tipping.

In operation, the vehicular apparatus is used to remove snow, ice, water and de-icing liquids from airport runways and aprons where the plane is sprayed with de-icing material. For purposes of removing such material as the apparatus traverses the surface, brushes 10 are lowered and rotated to sweep the snow underneath the apparatus as shown in FIG. 2. At the same time, transport elevator 20 is rotated along with cylindrical brush 16. Heated water is pumped from water tank 54 to nozzles 88 in head 72 at the desired pressure to loosen ice and liquid to make it airborne. Vacuum fan 62 is driven to create a vacuum in tank 60 and to create an air sweep that enters head 72 through opening 84 at a velocity sufficient to carry the airborne material into tank 60. Concurrently therewith, squeegee 90 on head 72 contacts the surface to keep the liquid in the head and provide a surface substantially free of liquid. Snow and ice in container 6 is melted and pumped to container 60 on a more or less continuous basis. When container 60 is full of liquid, it may be dumped into a stationary container through discharge ports 94. When container 6 becomes full of debris, it may be dumped into a receptacle using hydraulic arms 67 and filter 42 may be washed using a high pressure water hose. Similarly, container 60 can be tipped using hydraulic arms 67*a* to remove any build-up of residue, e.g., sand, therein. Thus, the vehicular apparatus is capable of removing snow, ice, de-icing liquid and water in one pass over an airport runway or apron. Further, the vehicular apparatus has the capability of lowering de-icing fluids in 100 square centimeters from 4,000 to 5,000 mg to 30 mg or less, e.g., even as low as about 3 mg.

While the invention has been disclosed with respect to preferred embodiments, the claims are intended to encompass other embodiments which come within the spirit of the invention.

What is claimed is:

1. A vehicular apparatus adapted for removing fluids including snow and/or ice and de-icing or anti-icing liquids from a surface as said apparatus traverses said surface, the apparatus comprising:

(a) a first container for depositing a first portion of said fluids removed from a zone of said surface;

(b) means for collecting and means for transferring the first portion of said fluids from said zone to said first container;

(c) a second container capable of being maintained at less than atmospheric pressure for depositing residual fluids remaining on said zone of said surface after said first portion of fluids is removed;

(d) a head device connected by a conduit to said second container, the head device being open to said surface and having a forward wall located above said surface to permit entry of said residual fluids into said head device, the head device comprising:

(i) means for impinging water at a high pressure on said surface to loosen said residual fluids;

(ii) side walls connected to a rear wall having a concave curved shape, the side walls and rear wall connected forward of said concave curved shape, said rear wall provided with a wiper blade for contacting said surface for maintaining residual fluids and water in a region defined by said head device for removal to said second container;

(iii) a top wall connected to said side walls and said rear wall, the top wall having a concave-shaped opening therein adjacent said rear wall; and (iv) said conduit having a lower portion connected to said concave-shaped opening, the lower portion of said conduit defined by a concave-shaped forward wall and a concave-shaped rear wall, said concave-shaped forward wall and said concave-shaped rear wall having edges connected to form said conduit, said concave-shaped rear wall and said concave-shaped forward wall tapered inwardly from said concave-shaped opening to form a conduit having a generally concave shape in cross section at said opening to a substantially circular cross section at an upper portion; and (e) air sweep means in fluid communication with said second container for drawing said loosened residual fluids and water in said head device through said conduit into said second container.

2. The vehicular apparatus in accordance with claim 1 wherein said conduit has a substantially uniform cross-sectional area from said concave-shaped opening to said substantially circular cross section.

3. The vehicular apparatus in accordance with claim 1 wherein said first container has a heating means for melting snow or ice deposited therein.

4. The vehicular apparatus in accordance with claim 1 wherein said first container contains filter means for filtering liquids in the first container.

5. The vehicular apparatus in accordance with claim 1 including means for transferring fluid in liquid form from said first container to said second container.

6. The vehicular apparatus in accordance with claim 1 wherein said air sweep means is used for maintaining said second container at less than atmospheric pressure.

7. The vehicular apparatus in accordance with claim 1 wherein said means for impinging water is capable of impinging water at a pressure in the range of 250 to 10,000 psi and said air sweep means is capable of flowing air into said second container at a rate of 8,000 to 20,000 CFM.

8. The vehicular apparatus in accordance with claim 1 wherein said second container has a first end and a second end, the first end positioned substantially opposite said second end and at least one vacuum fan which is said air sweep means in communication with the first end of said second container, said vacuum fan operable to maintain said second container under said less than atmospheric conditions.

9. The vehicular apparatus in accordance with claim 8 wherein said second container has a baffle means substantially opposite an entrance of said conduit, said baffle means providing separation of fluids from air in said second container.

10. The apparatus in accordance with claim 8 wherein said vacuum fan comprises:

(a) a cylindrical housing having a first end in axial alignment with a circular opening in said first end of said second container, said cylindrical housing having a second end substantially opposite said first end of said housing; and (b) an impeller comprised of a circular plate axially aligned in said cylindrical housing, said plate mounted to rotate in an axis of said housing, said plate having blades mounted perpendicular to said plate and extending generally radially from a center of said plate, said impeller designed to rotate and ingest air axially from the second container, then radially, and expel said air from said cylindrical housing.

11. The apparatus in accordance with claim 10 wherein said blades are curved backwardly from the direction of rotation.

12. A vehicular apparatus adapted for removing fluids including snow and/or ice and de-icing liquids from a surface as said apparatus traverses said surface, the apparatus comprising:

(a) a first container for depositing a first portion of said fluids removed from a zone of said surface;

(b) means for collecting and means for transferring the first portion of said fluids from said zone to said first container;

(c) a second container having a first end and a second end, the first end positioned substantially opposite said second end and at least one vacuum fan in communication with the first end of said second container, said vacuum fan operable to maintain said second container under less than atmospheric pressure;

(d) a head device connected by a conduit to said second container, the head device being open to said surface and having a forward wall located above said surface to permit entry of residual fluids into said head device, the head device comprising:

(i) means for impinging water at a high pressure on said surface to loosen residual fluids;

(ii) side walls connected to a rear wall having a concave curved shape, the side walls and rear wall connected forward of said concave curved shape, said rear wall provided with a wiper blade for contacting said surface for maintaining residual fluids and water in a region defined by said head device for removal to said second container;

(iii) a top wall connected to said side walls and said rear wall, the top wall having a concave-shaped opening therein generally parallel to said rear wall; and (iv) said conduit having a lower portion connected to said concave-shaped opening, the lower portion of said conduit defined by a concave-shaped forward wall and a concave-shaped rear wall, said forward wall and said rear wall of said conduit having edges connected to form said conduit, said rear wall and said forward wall of said conduit tapered inwardly from said concave-shaped opening to form a conduit having a generally concave shape in cross section at said opening to a substantially circular cross section at an upper portion; and (e) an air sweep generated by said vacuum fan, said air sweep in fluid communication with said second container for drawing said loosened residual fluids and water in said head device through said conduit into said second container.

13. The apparatus in accordance with claim 12 wherein said vacuum fan is mounted on said first end of said second container.

14. The apparatus in accordance with claim 12 wherein said vacuum fan comprises:

(a) a cylindrical housing having a first end in axial alignment with a circular opening in said first end of said second container, said cylindrical housing having a second end substantially opposite said first end of said housing; and (b) an impeller comprised of a circular plate axially aligned in said cylindrical housing, said plate mounted to rotate in an axis of said housing, said plate having blades mounted perpendicular to said plate and extending generally radially from a center of said plate, said impeller designed to rotate and ingest air axially from the second container, then radially, and expel said air from said cylindrical housing.

15. The apparatus in accordance with claim 12 wherein said blades are curved backwardly from the direction of rotation.

* * * * *